US011897087B2

(12) United States Patent
Hardy et al.

(10) Patent No.: US 11,897,087 B2
(45) Date of Patent: Feb. 13, 2024

(54) POLISHING APPARATUS FOR SMOOTHING DIAMONDS

(71) Applicants: Board of Trustees of Michigan State University, East Lansing, MI (US); Fraunhofer USA, Plymouth, MI (US)

(72) Inventors: Aaron Hardy, East Lansing, MI (US); Timothy A. Grotjohn, Okemos, MI (US); Edward K. Drown, Haslett, MI (US); Michael Becker, East Lansing, MI (US)

(73) Assignees: Board of Trustees of Michigan State University, East Lansing, MI (US); Fraunhofer USA, Plymouth, MI (US)

( * ) Notice: Subject to any disclaimer, the term of this patent is extended or adjusted under 35 U.S.C. 154(b) by 0 days.

(21) Appl. No.: 17/922,728

(22) PCT Filed: Mar. 9, 2022

(86) PCT No.: PCT/US2022/019476

§ 371 (c)(1),
(2) Date: Nov. 1, 2022

(87) PCT Pub. No.: WO2022/192344

PCT Pub. Date: Sep. 15, 2022

(65) Prior Publication Data

US 2023/0286102 A1 Sep. 14, 2023

Related U.S. Application Data

(60) Provisional application No. 63/159,669, filed on Mar. 11, 2021.

(51) Int. Cl.
*B24B 9/16* (2006.01)
*B24B 37/10* (2012.01)
(Continued)

(52) U.S. Cl.
CPC ..... *B24B 9/161* (2013.01); *B24B 37/105* (2013.01); *B24B 37/26* (2013.01); *B24B 41/06* (2013.01)

(58) Field of Classification Search
CPC ..... B24B 37/04; B24B 37/042; B24B 37/048; B24B 37/102; B24B 37/105; B24B 37/107; B24B 37/30; B24B 41/06
See application file for complete search history.

(56) References Cited

U.S. PATENT DOCUMENTS 2,450,984 A 10/1948 Pastore
3,156,596 A * 11/1964 Miles ..... B24B 1/00 438/746

(Continued)

OTHER PUBLICATIONS

Raytechshaw Faceter, https://raytechshaw.com, (published Mar. 3, 2021).

(Continued)

*Primary Examiner* — Joel D Crandall
(74) *Attorney, Agent, or Firm* — Harness, Dickey & Pierce, PLC

(57) ABSTRACT

A polishing apparatus is provided. Another aspect pertains to a self-leveling polishing apparatus for smoothing diamonds. Yet another aspect of the present system uses a ball and swivel joint in a diamond polishing machine. A further aspect employs a polishing apparatus including a diamond-holder, an elongated arm using gravity to apply downward polishing pressure of the diamond workpiece against a polishing wheel, and a sweeping transmission to cause the holder to radially move across the rotating polishing wheel.

21 Claims, 8 Drawing Sheets

(51) Int. Cl.
*B24B 37/26* (2012.01)
*B24B 41/06* (2012.01)

(56) References Cited

U.S. PATENT DOCUMENTS 3,342,652 A * 9/1967 Reisman ..... H01L 21/30612 438/692
3,520,088 A 7/1970 Leibowitz
3,815,289 A * 6/1974 Hoffman ..... B24B 9/16 451/279
3,857,123 A * 12/1974 Walsh ..... B24B 37/107 451/288
3,902,283 A 9/1975 Bean
3,906,678 A * 9/1975 Roth ..... B24B 37/042 451/271
3,979,239 A * 9/1976 Walsh ..... H01L 21/02024 438/959
4,239,567 A * 12/1980 Winings ..... B24B 37/30 156/247
4,270,314 A * 6/1981 Cesna ..... F16C 35/06 451/288
4,536,992 A * 8/1985 Hennenfent ..... B24B 37/102 451/259
4,600,469 A * 7/1986 Fusco ..... H01L 29/221 257/E29.096
4,831,784 A * 5/1989 Takahashi ..... B24B 19/226 451/288
5,377,451 A * 1/1995 Leoni ..... B24B 37/102 451/287
5,472,370 A 12/1995 Malshe et al.
5,474,808 A 12/1995 Aslam
5,582,534 A * 12/1996 Shendon ..... B24B 37/30 451/291
5,674,107 A 10/1997 Graebner et al.
5,725,413 A 3/1998 Malashe et al.
5,746,931 A 5/1998 Graebner et al.
5,815,899 A * 10/1998 Chao ..... G02C 5/2254 29/436
6,284,315 B1 9/2001 Tzeng
6,402,595 B1 * 6/2002 Fiesser ..... B24B 49/006 451/286
9,259,819 B2 2/2016 Singh et al.
10,541,118 B2 1/2020 Grotjohn et al.
2009/0318059 A1 * 12/2009 Shewey ..... B24B 37/04 451/10
2017/0120415 A1 * 5/2017 Ting ..... B24B 37/20
2017/0271132 A1 9/2017 Grotjohn et al.
2020/0206870 A1 7/2020 Lee et al.

OTHER PUBLICATIONS

Raytechshaw Faceter Features and Benefits, https://raytechshaw.com/equipment , (published Mar. 3, 2021).
McMaster-Carr, "Drawing of Swivel Leveling Mount with Threaded Hole part No. 6103K147, McMaster-Carr Supply Co." (offered for sale or published 2016).
Hocheng, H., et al., "Chemical-Assisted Mechanical Polishing of Diamond Film on Wafer," Materials Science Forum vols. 505-507 (2006) pp. 1225-1230.
Yuan, Z., et al., "Chemical Mechanical Polishing Slurries for Chemically Vapor-Deposited Diamond Films," Journal of Manufacturing Science and Engineering Aug. 2013) vol. 135 pp. 041006-1 through 041006-8.
Kubota, A., et al., "Surface smoothing of single-crystal diamond (100) substrate by polishing technique" Diamond & Related Materials vol. 24 (2012) pp. 59-62.
Thomas, E. L. H., et al., "Silica based polishing of {100} and {111} single crystal diamond" Science and Technology of Advanced Materials vol. 15 (2014) pp. 035013 (7pp).

* cited by examiner

POLISHING APPARATUS FOR SMOOTHING DIAMONDS

CROSS-REFERENCE TO RELATED APPLICATIONS

The present application is a national phase entry of PCT patent application serial no. PCT/US2022/019476 filed on Mar. 9, 2022, which claims priority to U.S. provisional patent application Ser. No. 63/159,669 filed on Mar. 11, 2021, both of which are incorporated by reference herein.

GOVERNMENT SUPPORT

This invention was made with government support under N00014-18-1-2032 awarded by the U.S. Office of Naval Research. The government has certain rights in the invention.

BACKGROUND

The present application relates generally to a polishing apparatus and more particularly to a self-leveling polishing apparatus for smoothing diamonds.

Conventional chemical-mechanical ("CMP") diamond polishing methods use soft materials for a polishing lap, such as felt, polyurethane or the like. These traditional soft laps can lead to "lensing" of the polished diamond surface due to enhanced material removal near the perimeter edges of the diamond workpiece. This occurs when the polishing lap deforms under the polishing load due to the downward force applied to the sample, or if the chemical-mechanical polishing action deteriorates the lap material creating a "wear track." Either scenario results in uneven wear of the diamond surface, which is problematic in numerous potential applications.

Another traditional device is disclosed in U.S. Pat. No. 5,725,413 entitled "Apparatus for and Method of Polishing and Planarizing Polycrystalline Diamonds, and Polishing and Planarized Polycrystalline Diamonds and Products made therefrom" which issued to Malashe et al. on Mar. 10, 1998, and is incorporated by reference herein. This Malashe patent, however, requires a perpendicularly offset pair of universal joint axes in order to withstand its 20-100 kg/cm$^2$ forces of the diamond workpiece against the polishing wheel. It is also noteworthy that the Malashe sample holder and polishing wheel rotate simultaneously, and that a heater is used.

SUMMARY

In accordance with the present invention, a polishing apparatus is provided. Another aspect pertains to a self-leveling polishing apparatus for smoothing diamonds. Yet another aspect of the present system uses a ball and swivel joint in a diamond polishing machine. A further aspect employs a polishing apparatus including a diamond-holder, an elongated arm using gravity to apply downward polishing pressure of the diamond workpiece against a polishing wheel, and a sweeping transmission to cause the holder to radially move across the rotating polishing wheel. In another aspect, a method finely polishes a diamond workpiece using a self-leveling ball and socket joint for a dop holder which radially sweeps back and forth, and/or an elongated arm using gravity to apply downward polishing pressure of the diamond workpiece against a rotating polishing lap.

The present system and method are advantageous over prior constructions. For example, the present system and method cause self-leveling of the diamond workpiece relative to the rotating polishing lap, thereby allowing even and uniform material removal in minimal processing time, without undesired "lensing" of the workpiece's outer areas. The present system and method also deter gouges or rotational tracks from being created in the workpiece and/or polishing wheel. Moreover, the present ball and socket joint is better suited for sealing in grease and deterring entry of the chemical slurry and polishing debris as compared to an exposed universal joint. The combined synergies of the present apparatus and method allow for very fine chemical-mechanical polishing of thin and epitaxially grown, single-crystal or polycrystalline diamonds without excessive removal of material, beneficially achieving a sub-nanometer level of roughness, which is ideally suited for surface sensitive applications, such as electronic components. Additional advantages and features of the present invention can be ascertained from the following description and appended claims, taken in conjunction with the accompanying drawings.

DETAILED DESCRIPTION

Figure 1:
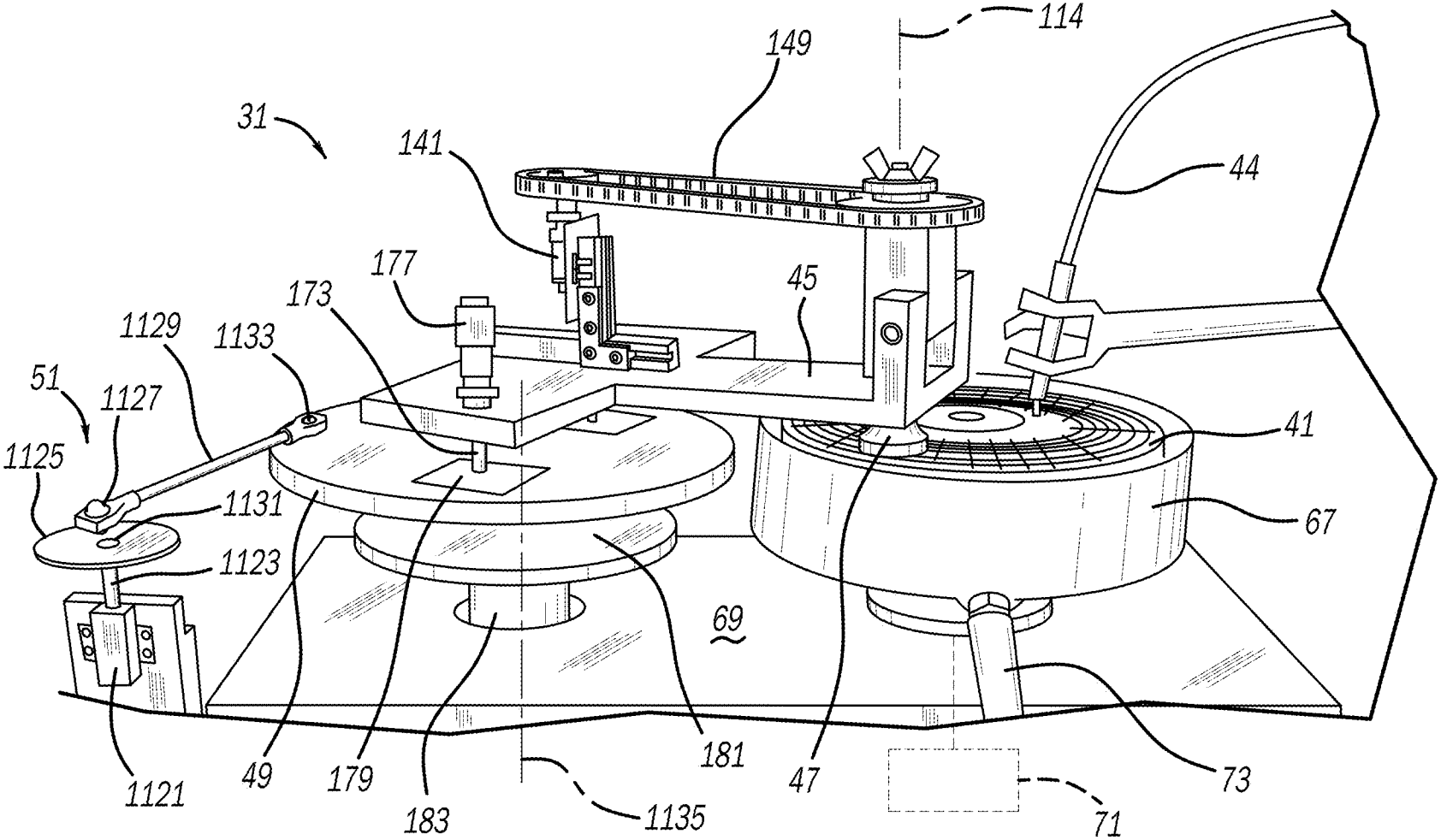
FIG. 1 is a perspective view showing a preferred embodiment of the present polishing apparatus.
Figure 2:
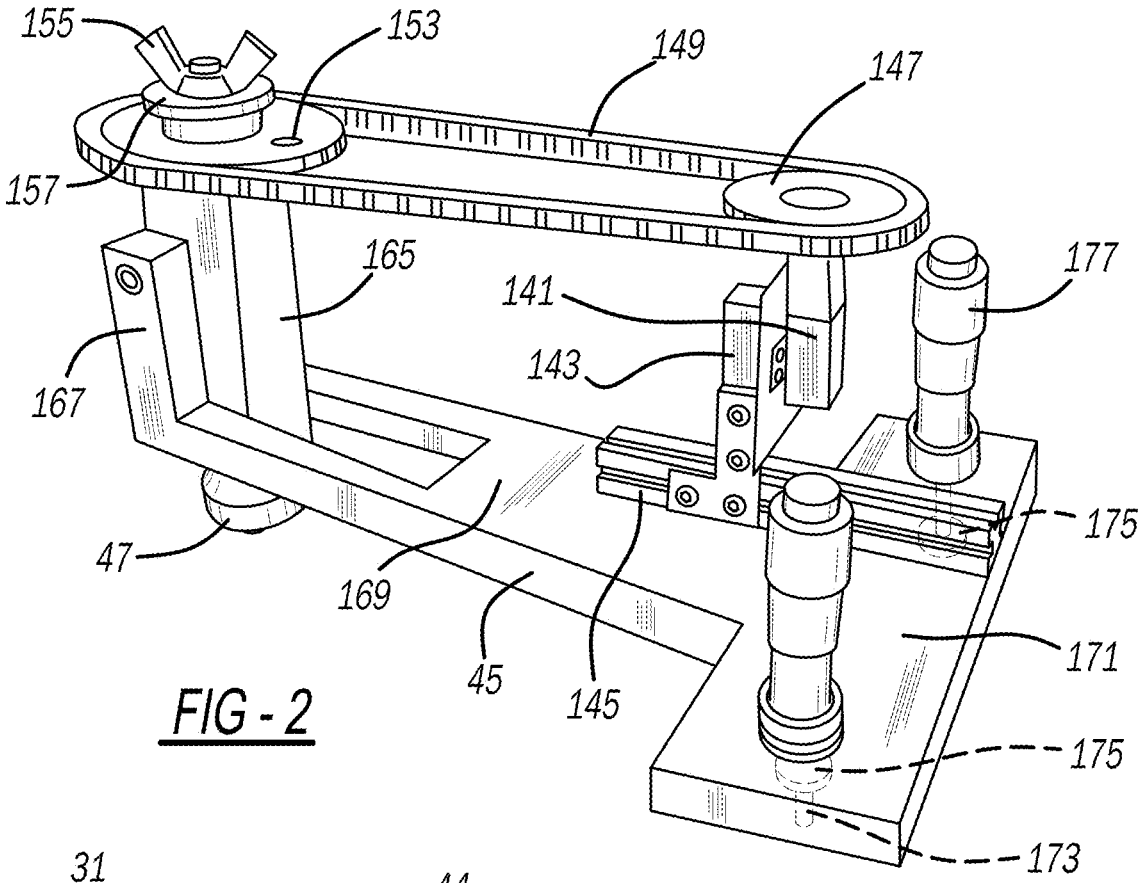
FIG. 2 is a perspective view showing an arm assembly of the present polishing apparatus.
Figure 3:
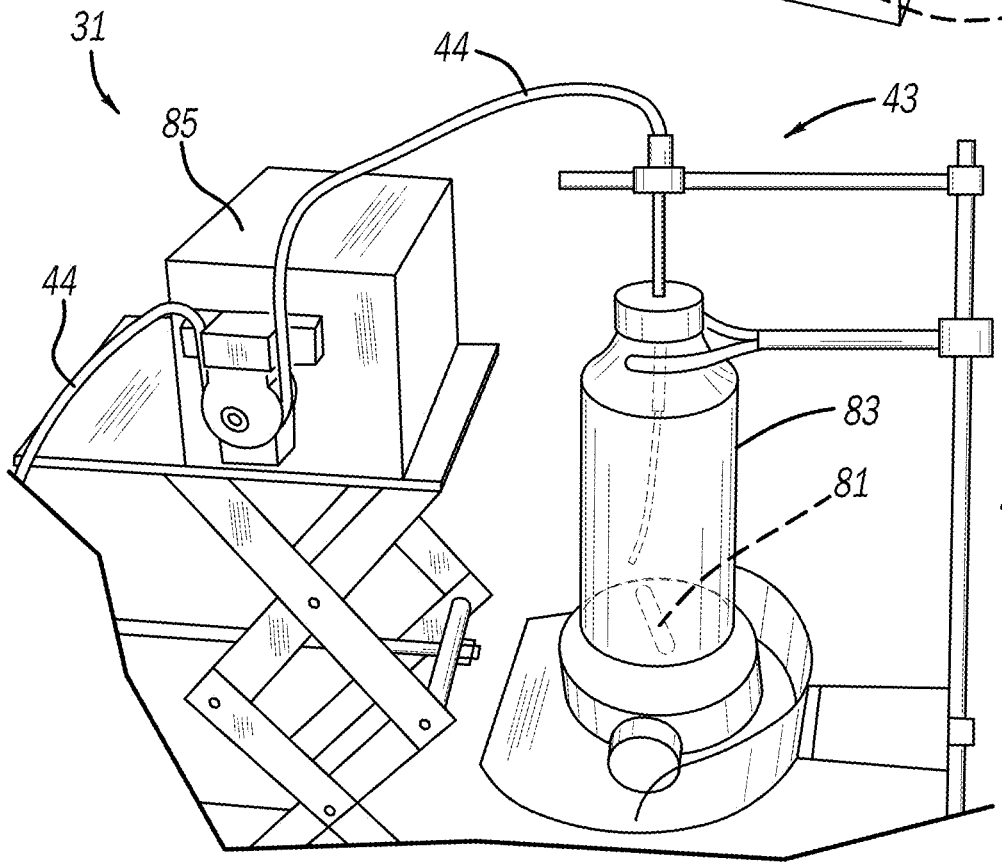
FIG. 3 is a perspective view showing a slurry system of the present polishing apparatus.
Figure 4:
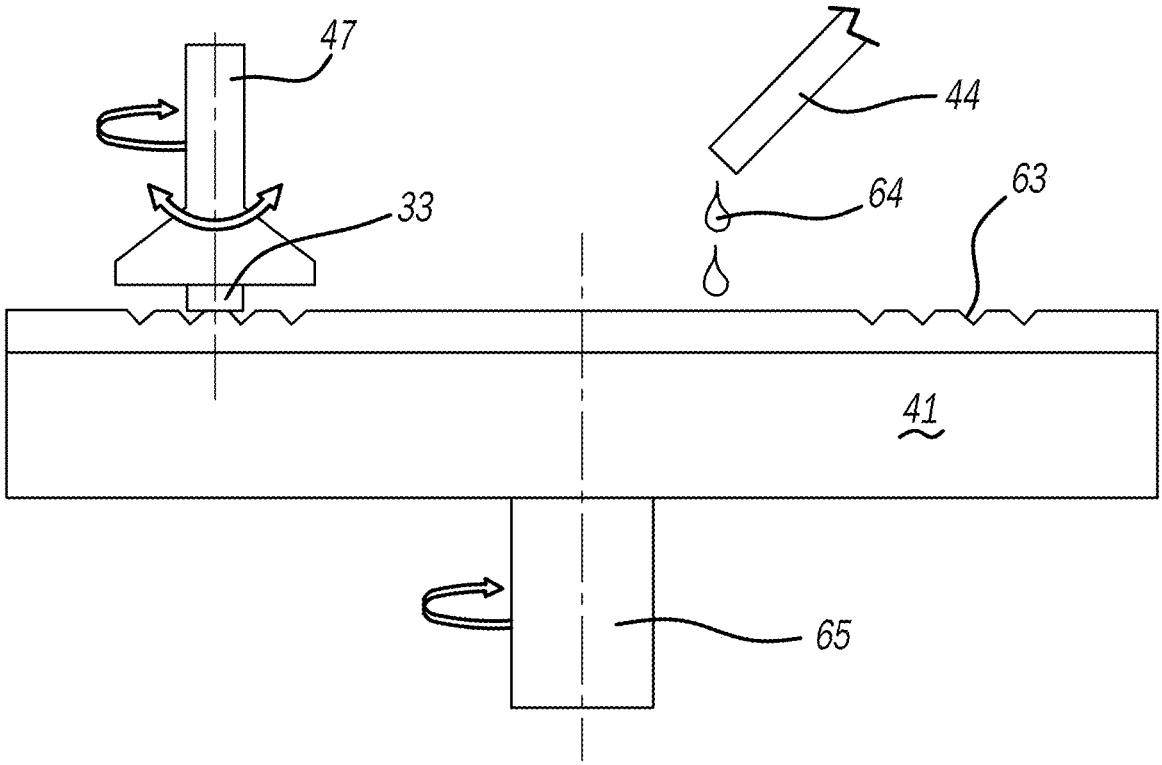
FIG. 4 is a diagrammatic side view showing a dop and polishing wheel of the present polishing apparatus.
Figure 6:
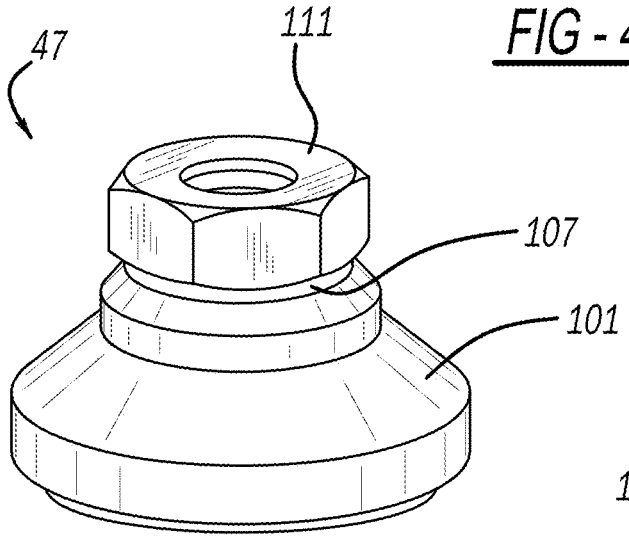
FIG. 6 is perspective view showing a foot and joint of the dop employed in the present polishing apparatus.
Figure 7:
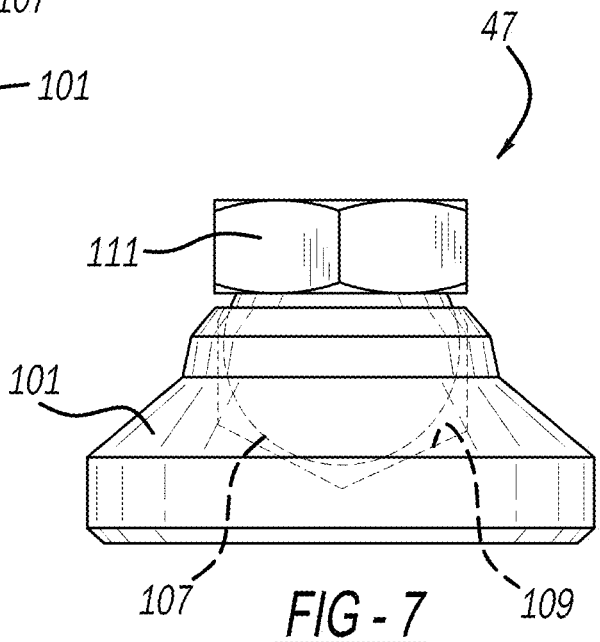
FIG. 7 is a side elevational view showing the foot and joint of the dop employed in the present polishing apparatus.
Figure 5:
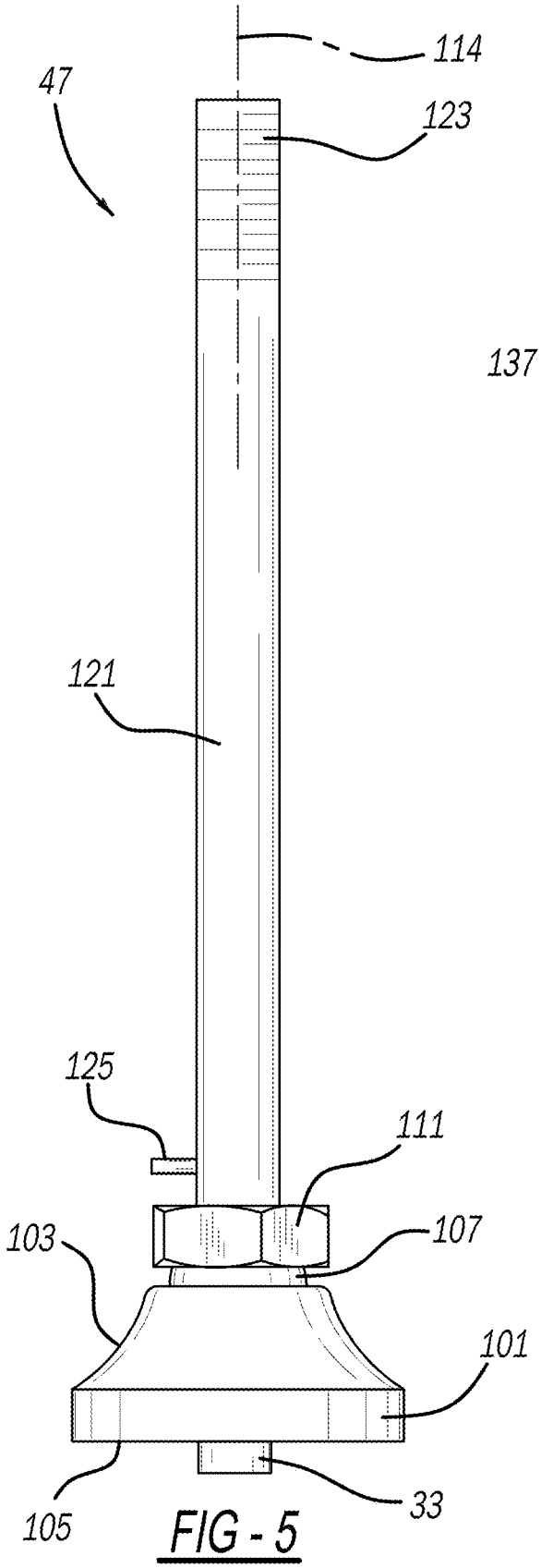
FIG. 5 is a side elevational view showing the dop and a diamond workpiece of the present polishing apparatus.
Figure 8:
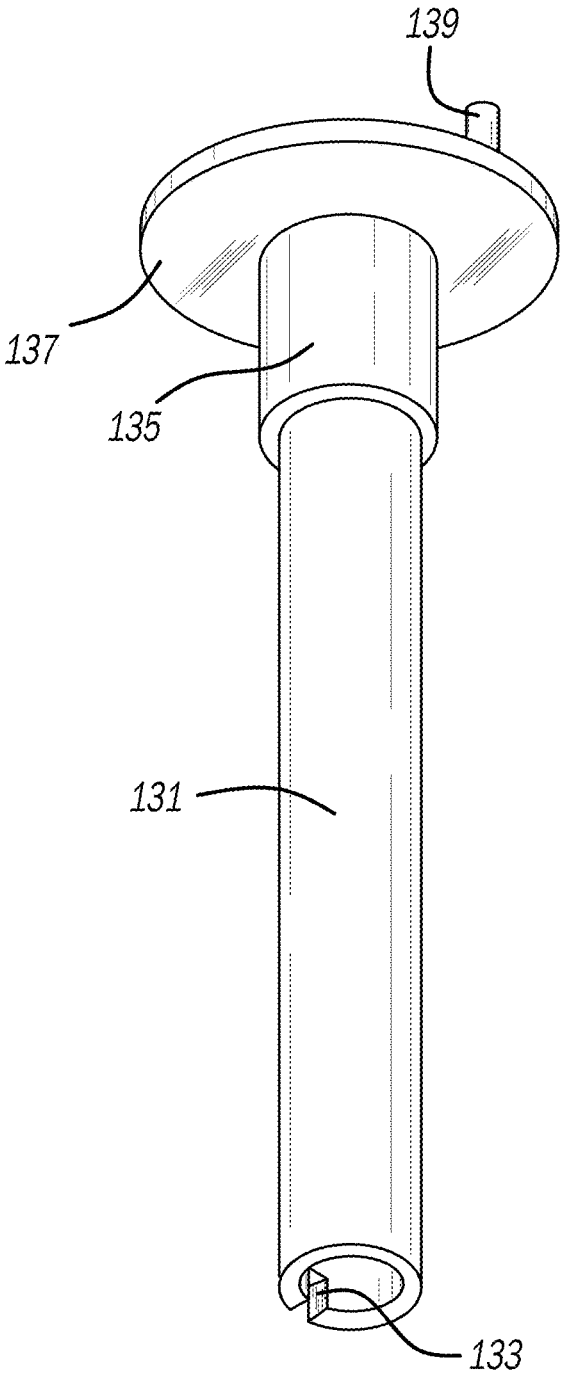
FIG. 8 is a perspective view showing a sleeve of the present polishing apparatus.
Figure 9:
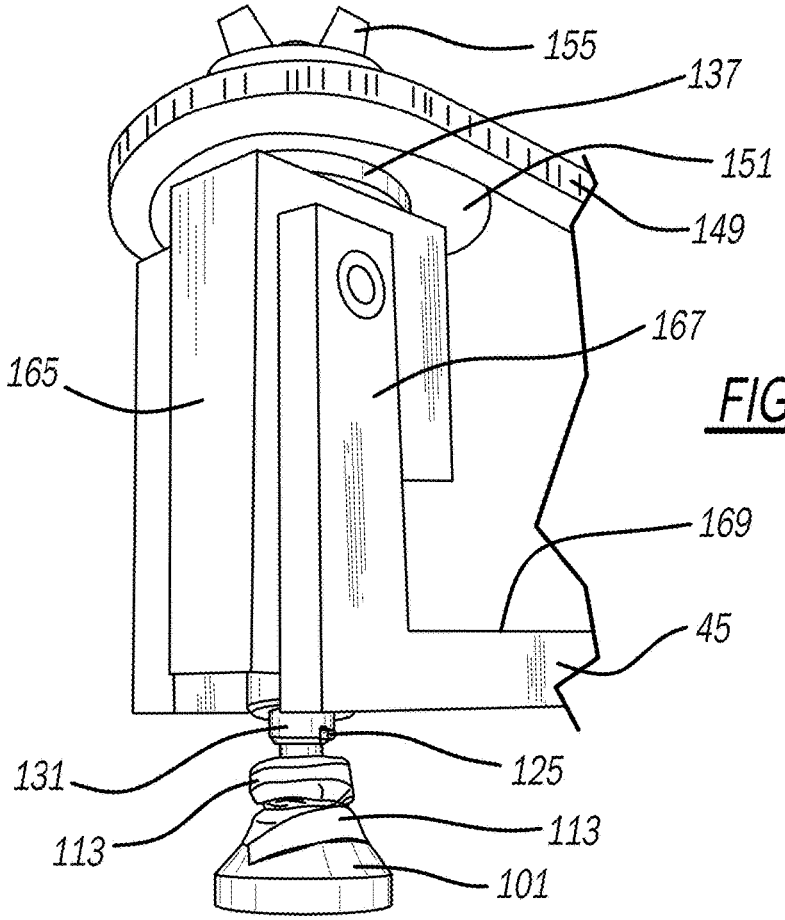
FIG. 9 is a fragmentary perspective view showing the arm and dop of the present polishing apparatus.

A preferred embodiment of a polishing apparatus 31 is illustrated in FIGS. 1-9. Polishing apparatus 31 is preferably employed to finely polish epitaxially grown, synthetic diamond workpieces 33 such as one including an outer diamond film layer on a base wafer substrate layer. In one example, the combined layers of diamond 33 and the underlying substrate both have a generally rectangular peripheral shape of about 3-100 mm in a height and/or width dimension, such as 3×3 mm, more preferably about 5×5 mm, and even more preferably about 10×10 mm. The combined layers of diamond 33 also are about 1 mm thick, with the outer film layer being less than 50 microns thick, and more preferably less than 10 microns thick, and even more preferably less than 4 microns thick, if the workpiece is part of an electronic component such as a transistor or diode. The diamonds are made using a chemical vapor deposition reactor in accordance with: U.S. Pat. No. 10,541,118 entitled "Methods and Apparatus for Microwave Plasma Assisted Chemical Vapor Deposition Reactors" which issued to common co-inventor Grotjohn et al on Jan. 21, 2020; and/or commonly owned U.S. Pat. No. 5,474,808 entitled "Method of Seeding Diamond" which issued to Aslam on Dec. 12, 1995. These patents are incorporated by reference herein. Other diamond growth techniques may alternately be employed, such as hot filament or liquid alcohol plasma processes.

Polishing apparatus includes a polishing wheel or lap 41, a chemical slurry dosing assembly 43 including a drip tube 44, a positioning arm 45, a holder or dop 47, a sweeping platform 49 and a sweeping transmission 51. Lap 41 preferably has a rigid and chemically inert, alumina ceramic polishing layer with multiple spaced apart, concentric and circular grooves 63 therein. Radial grooves may also be provided in the lap. Each groove has a width of less than 0.5 mm to carry and distribute the chemical slurry 64. Furthermore, lap 41 rotates on top of a central pedestal 65, within a tub 67, on top of a table 69. The pedestal extends through a hole in the table and an electric motor 71 is coupled to and operably rotates pedestal 65 and lap 41 when energized. An outlet tube 73 is coupled to tub 67 to remove the used chemical slurry 64.

The lap preferably rotates at a speed of 100 to 600 rpm and more preferably 150-200 rpm. Once every 5-10 minutes during polishing, the lap is rinsed with between 20-100 mL of HPLC water in order to keep abrasive residue and oxidized byproducts from accumulating. The excess slurry and water are rinsed off of the lap and into the tub, which drains into a waste container for disposal. The polishing apparatus is housed in a surrounding and sealed environmental enclosure which is continuously flushed with a well-filtered air supply (0.5 μm final filtration) or a laminar flow high-efficiency particulate air filtered cabinet enclosure, such as a Purair® Flow-36 model. The air flow is sufficient to provide positive pressure to reduce, eliminate and prevent the introduction of undesired particles into the process. The chemical slurry and the polishing process are conducted at room temperature, and preferably without a heater.

Slurry dosing system 43 is a CMP process using the aqueous slurry 64 which contains a strong oxidizing agent such as potassium permanganate, at least one acid such as phosphoric acid, and abrasive particles. The abrasive particles are each less than 3 μm in size and are softer than the diamond, for example boron carbide, which are kept in suspension through continuous stirring. Deionized or HPLC water is used as a solvent in this solution.

The slurry is continuously agitated using a magnetic stirrer 81. A slurry reservoir 83 is shielded from light exposure during operation by an outer cover or coating. A peristaltic pump 85 delivers one drop of the slurry to the lap every 1 to 10 seconds during operation, through feeding tubes 44.

Dop 47 includes a foot 101 having an arcuately curved and tapered upper surface 103, and a substantially flat bottom surface 105 to which diamond workpiece 33 is temporarily mounted. An adhesive secures the diamond to the foot for polishing and thereafter, the adhesive is softened so the diamond can be removed. A partially spherical ball 107 is trapped within a partially undercut cavity or socket 109 internal to foot 101, and an internally threaded nut 111 is mounted to an upper end of the ball. A rotatable joint is created by ball 107 rotating within socket 109 of foot 101, such that the ball and nut may rotate in any direction relative to the foot.

Moreover, foot 101, ball 107 and nut 111 are all preferably made of stainless steel to resist corrosion or pitting by the chemical slurry during polishing. Grease or another oil-based lubricant is packed into the socket and the joint is sealed with PTFE tape 113 or a flexible elastomeric boot to deter entry of the chemical slurry and/or removal of the grease. The tape also allows multidirectional swiveling of foot 101 relative to ball 107 but deters rotation of the foot about an axial centerline 114 of shaft 121. Sealing is beneficial since the slurry particles may otherwise deteriorate the fine ball and socket movement desired especially given the small downward polishing forces employed of less than 5 kg/cm$^2$ of diamond workpiece polishing surface area, and more preferably about 2.8 kg/cm$^2$ of surface area.

Dop 47 further includes a vertically elongated shaft 121 having external threads 123 at its upper and lower ends. A pin 125 radially projects outwardly adjacent the lower end of shaft 121, in a direction perpendicular to the vertically elongated axis of the shaft. The lower threads of shaft 121 mate within nut 111 such that foot 101 is moveable relative to the fixed ball 107 and attached shaft.

A hollow and cylindrical sleeve 131 is also vertically elongated and concentrically surrounds a majority of shaft 121. Sleeve 131 includes an openly accessible notch or slot 133 adjacent a bottom thereof. Additionally, a collar 135 and flange 137 are affixed at an opposite top of sleeve 131. An upstanding engagement structure 139, such as a cylindrical finger, projects from a top surface of flange 137 offset from a centerline of the shaft. Pin 125 of shaft 121 is received within notch 133 of sleeve 131 such that the shaft must rotate with the sleeve.

A dop-driving motor actuator 141 is mounted to an upstanding bracket and post assembly 143, which is adjustably secured to arm 45 via a horizontally elongated rail 145. A driven sprocket 147 is rotated by actuator 141 to move a closed loop chain 149. A passive sprocket 151 is engaged with and rotated in response to movement of chain 149.

Moreover, finger 139 of flange 137 engages within a hole 153 of passive sprocket 151 to cause sleeve 131 and, in turn, shaft 121 and its coupled ball 107 to rotate in response to activation of actuator 141. Accordingly, foot 101 and its attached diamond workpiece 33 also rotate in response to activation of actuator 141. A wing nut 155 and Bellville spring 157 or washer secure the passive sprocket on top of flange 137. Bolted connections between bracket and post assembly 143 and rail 145 allow for assembly of the chain and also for taking up slack during use. It is alternately envisioned that a pulley and belt assembly, enmeshed gears, pneumatic or hydraulic fluid pistons, or other mechanical transmissions may be employed between actuator 141 and sleeve 131.

A vertically elongated adapter block 165 is secured between a pair of shoulders 167 upstanding from a horizontally elongated and bifurcated intermediate section 169 of arm 45. Adapter block 165 includes a central bore within which sleeve 131 and shaft 121 are disposed. A T-shaped end section 171 of arm 45 extends in a transverse direction perpendicular to an elongation direction of intermediate section 169. Bores are located in end section 171 within which are mounted threaded screw legs 173 secured by mounting collars. Legs 173 downwardly project from micrometers 177 which allow for gross or large scale leveling of dop 47 during initial machinery setup.

A sweeping motor actuator 1121 and associated output shaft 1123 operably rotate an output disk 1125. A pivot 1127 at a proximal end of a sweep rod 1129 is radially offset from a central rotational axis 1131 of output shaft 1123 and disk 1125 to create eccentric movement of the rod. A pivot 1133 at a distal end of rod 1129 is coupled to circular platform 49; pivot 1133 is also radially offset from a central rotational axis 1135 of the platform. The pivots are rod end bearings, such as Heim joints, so disk 1125 can operate at a constant unidirectional rpm to affect the sweeping motion. Disk 1125, rod 1129 and platform 49 are all part of the sweeping transmission 51 which causes the platform to rotate or oscillate back and forth within a 5-15 degree range.

Feet 175 of micrometers 177 are received within slots or receptacles in an upper surface of platform 49. Furthermore, feet 175 are magnetically coupled to magnetic areas 179 of the platform. This allow for easy disassembly of arm 45 from platform 49 so that the polished condition of the diamond workpiece can be ascertained at a different location and the diamond workpiece can be quickly removed in a tool-free manner when polishing is completed. Alternately, feet 175 may be bolted or otherwise mechanically attached to platform 49, however, some of the present advantages may not be realized. Bearings and additional supporting bracketry may be provided for all moving components in the present apparatus.

A laterally enlarged wheel 181 is threadably enmeshed with a jack screw 183 which allows platform 49 to be manually raised and lowered to provide gross adjustment during initial machinery setup. The arm assembly makes three-point contact when placed on the polishing unit; the diamond resting on the grooved ceramic lap and the two micrometers resting on the platform. The load on the diamond as it rests on the lap is about 325 g. Thus, for a 3.5×3.5 mm workpiece this results in a pressure of about 2.65 $kg/cm^2$ (260 kPa) on the diamond. If necessary, weights can be added or removed to the arm in order to adjust the downward pressure on the diamond. Therefore, gravity acting on the arm and attached components preferably supplies the only downward force on the dop which pushes the diamond workpiece against the polishing lap.

The ball and socket joint for dop 47 beneficially provides a fine and delicate self-leveling feature permitting the diamond workpiece to swivel but not rotate relative to the shaft. This feature is advantageous in at least two ways: first, the traditional time-consuming step of "balancing" the diamond is eliminated; and second, the diamond remains in intimate contact with the lap's surface during the sweeping and lap-rotational movements. Actuator 141 causes the diamond to rotate with shaft 121 about axis 114 at a rate of 3 to 20 rpm, and more preferably 6 to 10 rpm, during polishing. Rotating the dop and diamond is beneficial in that no one area of the diamond workpiece acts solely as the leading edge, which can result in unevenness in the removal of material from the diamond's surface.

Moreover, the use of the present self-leveling dop permits the chemical polishing of diamond surfaces without first needing to grind the diamond in a gross manner so that it is parallel to the lapping surface before CMP is started. It is also noteworthy that the self-leveling feature allows polishing of the diamond surface with very little diamond removal, thereby improving quality and processing cycle time and enabling the polishing of thin epitaxially grown layers such as those used for electronics applications.

The back and forth diamond sweeping motion across the lap advantageously prevents the diamond from remaining at a single polishing location long enough to produce uneven wear on the lap's surface. Also, the process is monitored by visually inspecting the diamond's surface using differential interference contrast microscopy. Once the polishing is judged complete, the adhesive is softened by heating the dop and the diamond can be removed.

Figure 11:
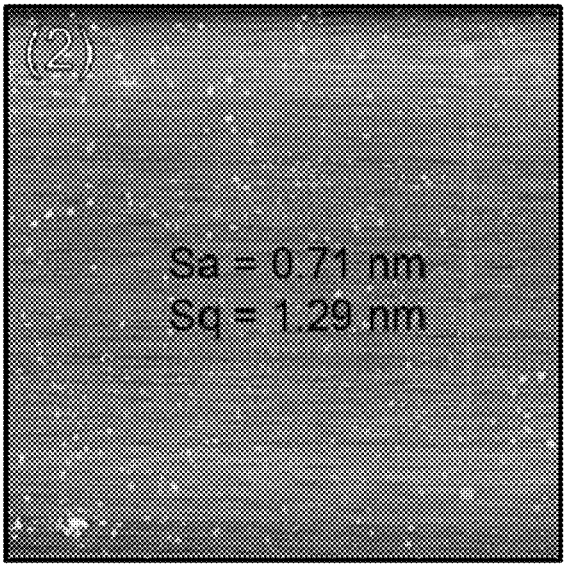
FIGS. 11 and 12 are atomic force microscope topographical scans showing a surface of a diamond using conventional polishing devices.
Figure 12:
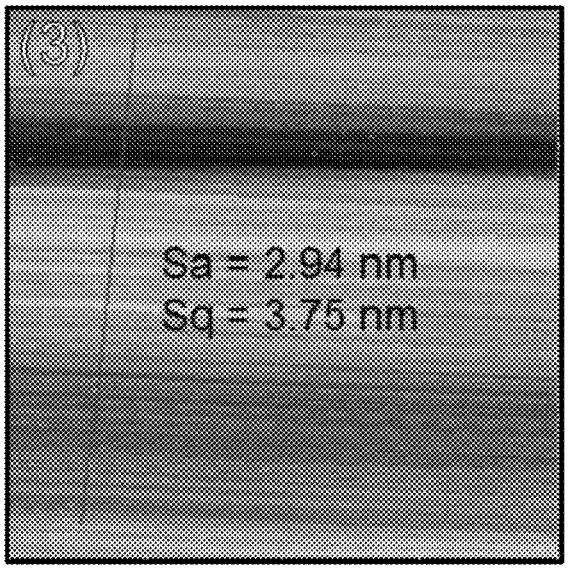
Figure 13:
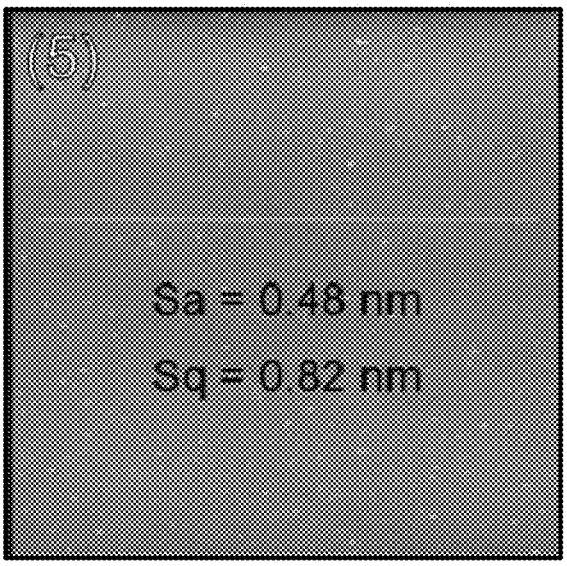
FIGS. 13 and 14 are atomic force microscope topographical scans showing a surface of a diamond using the present polishing apparatus.
Figure 14:
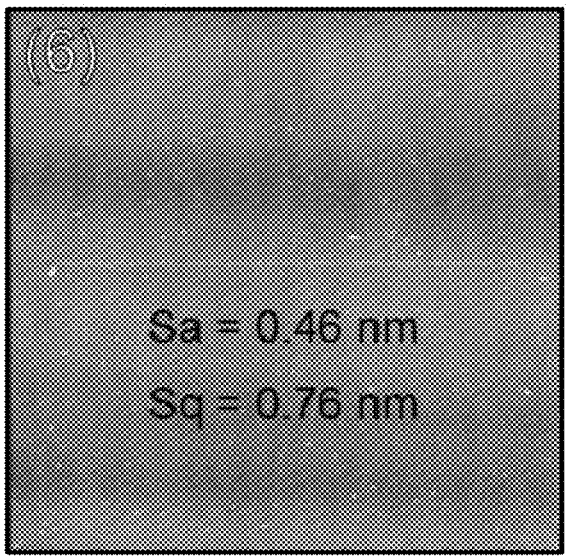
Figure 15:
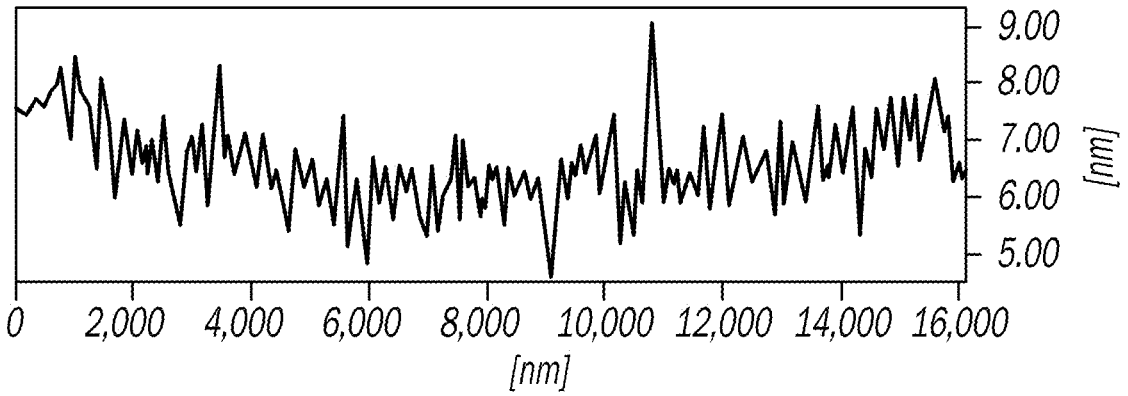
FIGS. 15 and 16 are graphs showing a surface roughness of the diamond using the conventional polishing devices, with the data taken along the lines of FIGS. 11 and 12, respectively, which are drawn perpendicular to mechanical polishing lines.
Figure 16:
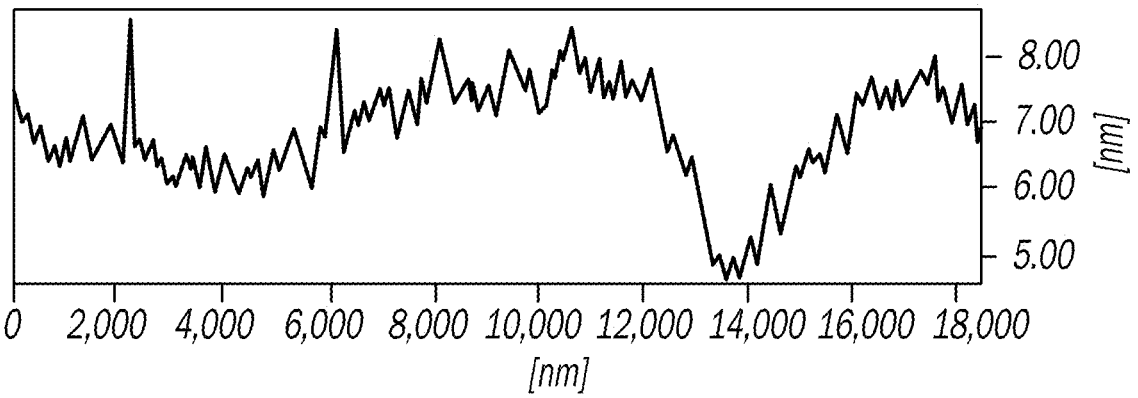
Figure 17:
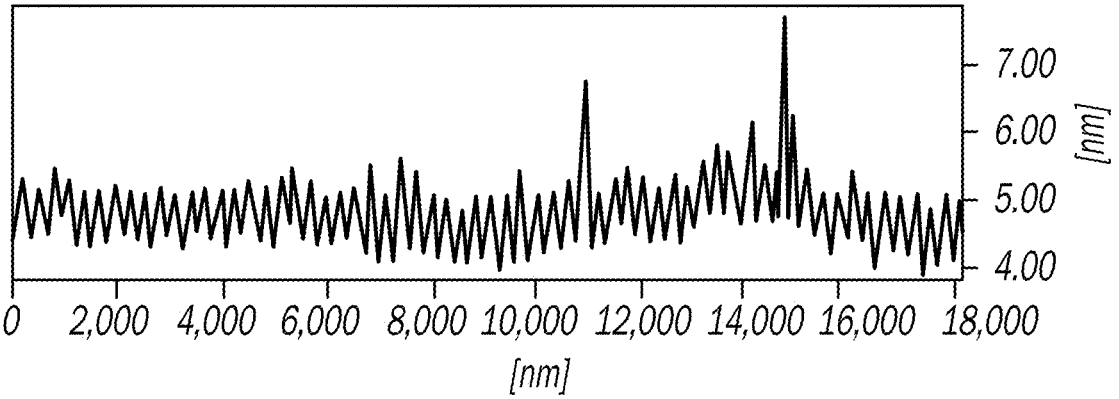
FIGS. 17 and 18 are graphs showing a surface roughness of the diamond using the present polishing apparatus, with the data taken along the lines of FIGS. 13 and 14, respectively.
Figure 18:
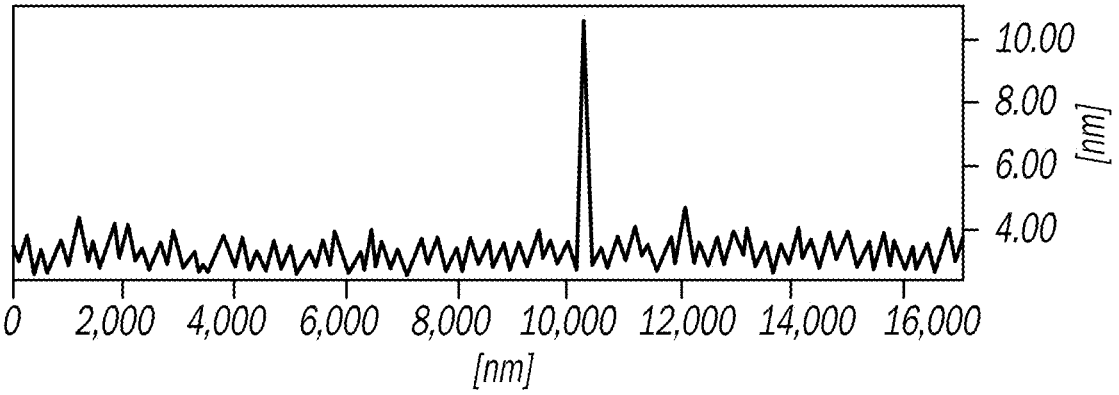

The material removal rate is between approximately 40 and 140 nm/hr. For a single crystal diamond sample with a surface area at least 3.5×3.5 $mm^2$ starting from a mechanically polished condition, the CMP process typically takes between 1 and 5 hours. An example of traditional polishing results is shown in FIGS. 11-12, in which case the roughness is measured to be Sq=1.29 nm and Sq=3.75 nm at two different locations on the mechanically polished surface of the workpiece. Expected results using the fine self-leveling dop of the present apparatus are shown in FIGS. 13 and 14, where after 60 minutes of the CMP process, Sq is expected to decrease to 0.82 and 0.76 nm at the two locations measured, which represents an extremely smooth and uniform surface. Sa is the arithmetical mean height and Sq is the root mean square height of the workpiece measured with an atomic force microscope on 20×20 $\mu m^2$ area scans. These expected results are graphically represented in the initially rough FIGS. 15 and 16, corresponding to FIGS. 11 and 12 respectively, as contrasted to the much smoother polished FIGS. 17 and 18, which correspond to FIGS. 13 and 14 respectively.

Figure 10:
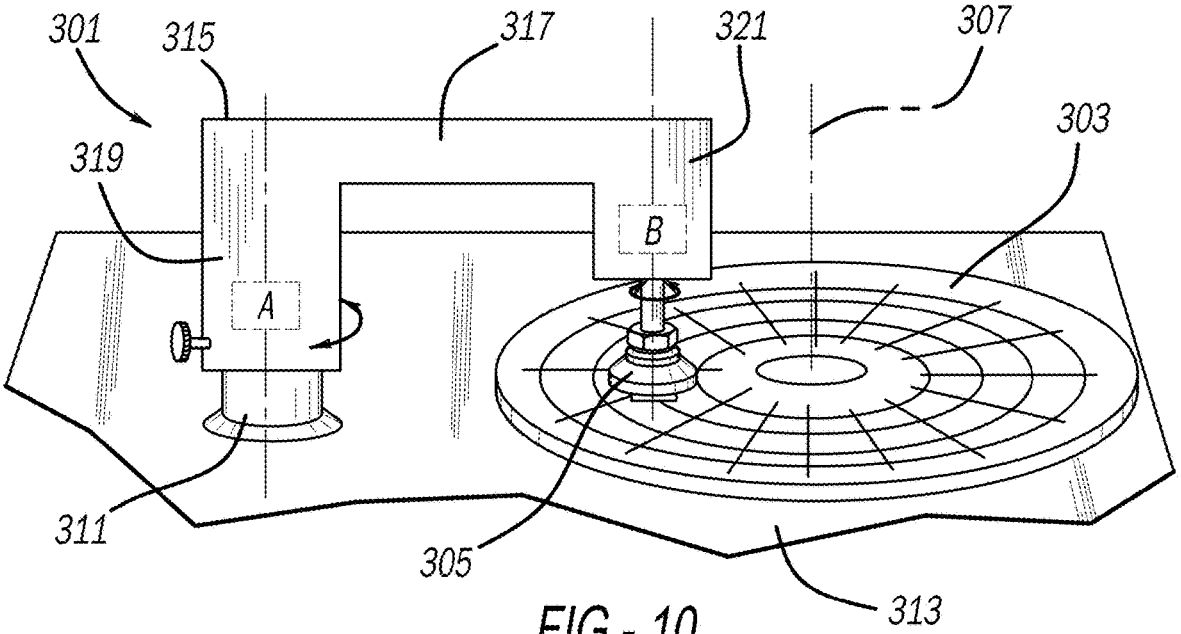
FIG. 10 is a diagrammatic view showing an alternate embodiment of the present polishing apparatus.

An alternate embodiment of the present polishing apparatus 301 is illustrated in FIG. 10. A motor-driven polishing lap 303 is employed with a chemically abrasive slurry like with the preferred embodiment. Furthermore, a self-leveling ball and socket dop 305 to hold a diamond workpiece, like that of the preferred embodiment, is also used in this exemplary embodiment. However, a simplified transmission mechanism is employed to sweep the dop and associated diamond, radially toward and away from the lap's rotational axis 307 while the lap rotates.

A post 311 is affixed to a table top 313. A generally inverted U-shaped arm 315, with a horizontally elongated intermediate section 317, has a proximal section 319 rotatably coupled about post 311 with a bearing or other coupling therebetween. A sweeping motorized actuator A and associated transmission rotate arm 317 back and forth relative to post 311. Furthermore, a driving motorized actuator B and associated transmission, attached to a distal section 321 of arm 317, operably rotate the shaft and foot of dop 305 without the need for a chain and sprockets. This embodiment is more compact and requires less components than the preferred embodiment.

All embodiments of the present apparatus and method of chemical-mechanical polishing of single-crystal or polycrystalline diamonds create a surface roughness of less than 2 nm and more preferably 0.1-0.3 nm. This process has applications in electronics and particle detectors, among other fields.

While various embodiments of the present invention have been disclosed, it should also be appreciated that other variations may be employed. For example, additional or alternate actuators, motion transmission or slurry components may be used, however, many of the performance advantages may not be achieved. It is alternately envisioned that alternate shapes and sizes may be utilized, although some of the preferred advantages may not be realized. Furthermore, additional or fewer processing steps can be used, although some benefits may not be obtained. It should also be appreciated that any of the preceding embodiments and features thereof can be mixed and matched with any of the others in any combination depending upon the final product and processing characteristics desired. Variations are not to be regarded as a departure from the present disclosure, and all such modifications are intended to be included within the scope and spirit of the present invention.

The invention claimed is:

1. A diamond polishing apparatus comprising:

a holder comprising a diamond-holding foot configured to temporarily secure a substrate, with an epitaxial diamond film grown on the substrate, the diamond film having a thickness less than 50 microns, said holder and said diamond-holding foot comprising a centerline axis;

a shaft upwardly extending from the holder;

a sealed, ball and socket joint coupling the shaft to the holder;

a substantially horizontally elongated arm including a receptacle within which is mounted the shaft, whereby gravity acting on the arm causes the holder to push toward an actuator-driven polishing lap;

and an actuator-driven transmission causing the arm to move the holder in a radial sweeping motion between inner and outer portions of the lap during polishing, said actuator-driven transmission comprising, a sweeping actuator;

a disk operably rotated by the sweeping actuator about a central axis;

an elongated rod pivotally coupled to the disk at a first pivot, said first pivot offset from the central axis; and the arm moving back and forth by movement of the rod in an eccentrical motion to cause the sweeping motion of the shaft and the holder above the lap while the lap is rotated;

a platform operably rotating in response to the rod pivotally coupled thereto at a second pivot;

a linearly adjustable micrometer supporting a portion of the arm, said arm positioned above the platform; and the arm held upon the platform only with gravity and the holder being held upon the lap only with the gravity.

2. The diamond polishing apparatus of claim 1, further comprising an actuator rotating the diamond-holding foot of the holder about the centerline axis during the polishing.

3. The diamond polishing apparatus of claim 2, further comprising an electric motor mounted to the arm, and the electric motor being configured to rotate the foot of the holder.

4. The diamond polishing apparatus of claim 1, further comprising:

an actuator configured to rotate the lap at a speed of 100 to 600 rpm within a tub; and an aqueous slurry located on the lap to assist with the polishing.

5. The diamond polishing apparatus of claim 4, further comprising a seal coupled to an exterior of the holder to deter the slurry from entering the ball and socket joint.

6. A diamond polishing comprising:

a holder comprising a diamond-holding foot configured to temporarily secure a substrate, with an epitaxial diamond film grown on the substrate, the diamond film having a thickness less than 50 microns;

a shaft upwardly extending from the holder;

a sealed, ball and socket joint coupling the shaft to the holder;

a substantially horizontally elongated arm including a receptacle within which is mounted the shaft, whereby gravity acting on the arm causes the holder to push toward an actuator-driven polishing lap;

an actuator-driven transmission causing the arm to move the holder in a radial sweeping motion between inner and outer portions of the lap during polishing;

an enclosure, including a filtered air supply, within which are located the holder and the lap during the polishing; and downward polishing forces caused by the gravity between the diamond film and the lap are less than 5 kg/cm$^2$.

7. The diamond polishing apparatus of claim 1, wherein the arm and the holder position the diamond film leveling relative to the lap to allow even and uniform material removal without lensing of the diamond film.

8. The diamond polishing apparatus of claim 1, wherein:

the diamond film has a thickness less than 4 microns;

at least one of a peripheral height or width of the diamond film has a linear dimension of at least 3 mm; and the diamond film and the substrate are part of an electronic transistor or diode.

9. A diamond polishing comprising:

a holder comprising a diamond-holding foot configured to temporarily secure a substrate, with an epitaxial diamond film grown on the substrate, the diamond film having a thickness less than 50 microns;

a shaft upwardly extending from the holder;

a sealed, ball and socket joint coupling the shaft to the holder;

a substantially horizontally elongated arm including a receptacle within which is mounted the shaft, whereby gravity acting on the arm causes the holder to push toward an actuator-driven polishing lap;

an actuator-driven transmission causing the arm to move the holder in a radial sweeping motion between inner and outer portions of the lap during polishing;

the lap comprises a ceramic material on a polishing surface of the lap, wherein the polishing surface further comprises spaced apart radial and concentric grooves therein.

10. A diamond polishing apparatus comprising:

a diamond workpiece;

a dop removably holding the diamond workpiece during polishing;

a shaft extending from the dop, said dop and said shaft comprising a centerline axis;

a ball and socket joint coupling the shaft to the dop;

an elongated arm mounted to the shaft, the arm being offset angled from the shaft;

a tub;

a polishing lap having a circular periphery;

a lap actuator rotating the lap in the tub;

a motorized dop actuator coupled to the arm and rotating a portion of the dop about the centerline axis during the polishing;

an aqueous slurry located on the lap to assist with the polishing.

11. The diamond polishing apparatus of claim 10, further comprising:

a sweeping actuator;

a disk operably rotated by the sweeping actuator about a central axis;

an elongated rod coupled to the disk, said rod offset from the central axis; and the arm moving back and forth by movement of the rod, said rod moving in an eccentrical motion to cause a radial sweeping motion of the shaft and the dop above the lap while the lap is rotated.

12. The diamond polishing apparatus of claim 11, further comprising:

a platform operably rotating in response to the rod pivotally coupled thereto;

a linearly adjustable micrometer supporting a portion of the arm above the platform; and the arm and the dop being held upon the platform and the lap only with gravity and being removable from the platform.

13. The diamond polishing apparatus of claim 10, further comprising a seal coupled to an exterior of the portion of the dop to deter the slurry from entering the ball and socket joint.

14. The diamond polishing apparatus of claim 10, further comprising an elongated and hollow collar surrounding the shaft, and an offset pin couples the collar to the shaft.

15. The diamond polishing apparatus of claim 10, further comprising a mechanical transmission coupled to the motorized dop actuator, said actuator comprising an electric motor mounted to the arm at a location laterally offset from a rotational axis of the dop, the arm being elongated in a substantially horizontal direction above the dop and the lap, the electric motor being configured to rotate the portion of the dop, the lap including a ceramic polishing material and the lap including spaced apart grooves therein.

16. The diamond polishing apparatus of claim 10, further comprising:

a seal coupled to an exterior of area of the dop to deter the slurry from entering the ball and socket joint; and an enclosure, including a filtered air supply, within which are located the dop and the lap during the polishing;

downward polishing forces caused by gravity between the diamond workpiece and the lap are less than 5 kg/cm$^2$; and the arm and the dop causing the diamond workpiece to be self-leveling relative to the lap to allow even and uniform material removal without lensing of the diamond workpiece.

17. A method for polishing a diamond workpiece, the method comprising:

attaching the diamond workpiece to a holder;

rotating a lap below the holder;

self-leveling the diamond workpiece relative to the lap via a ball and socket joint of the holder to allow uniform material removal without lensing of the diamond workpiece;

pushing the holder and the diamond workpiece toward the lap only with gravity and with downward polishing forces caused by gravity and being less than 5 kg/cm$^2$, during the polishing;

the holder being retractable from the lap radially sweeping the holder between inner and outer portions of the lap, during the polishing by moving a substantially horizontally elongated arm.

18. The method of claim 17, further comprising:

flowing an aqueous slurry onto the lap;

sealing in grease within the ball and socket joint with a seal applied to the holder;

deterring the slurry from entering the ball and socket joint with the seal; and distributing the slurry with spaced apart radial grooves in a polishing surface of the lap.

19. The method of claim 17, further comprising:

energizing an actuator to cause eccentric motion;

causing a first end of the substantially horizontally elongated arm to move based on the eccentric motion, which in turn, causes a second end of the arm to repeatedly oscillate the holder back and forth in the radial sweeping motion above the lap; and linearly adjusting the arm relative to the lap.

20. The method of claim 17, further comprising energizing an actuator located above horizontal plane through a polishing surface of the lap, and rotating the holder due to the actuator energizing during the polishing.

21. The method of claim 17, wherein:

the diamond workpiece comprises a substrate with an epitaxially grown diamond film layer thereon;

the diamond film layer has a thickness less than 50 microns;

the diamond film layer is created with chemical vapor deposition; and the holder and lap polish with sub-nanometer roughness.

* * * * *